US007966727B2

(12) United States Patent
Kawashima et al.

(10) Patent No.: US 7,966,727 B2
(45) Date of Patent: Jun. 28, 2011

(54) INSTALLATION CONSTRUCTION METHOD FOR BOILER FACILITIES

(75) Inventors: Hiroki Kawashima, Kure (JP); Toshihiro Masaki, Kure (JP); Yasuaki Kawashima, Kure (JP); Kazuki Tatehira, Kure (JP)

(73) Assignee: Babcock-Hitachi Kabushiki Kaisha, Tokyo (JP)

( * ) Notice: Subject to any disclaimer, the term of this patent is extended or adjusted under 35 U.S.C. 154(b) by 1277 days.

(21) Appl. No.: 11/522,921

(22) Filed: Sep. 19, 2006

(65) Prior Publication Data

US 2007/0089295 A1 Apr. 26, 2007

(30) Foreign Application Priority Data

Oct. 12, 2005 (JP) ..... 2005-297867

(51) Int. Cl.
*B23P 15/26* (2006.01)
*B21D 51/24* (2006.01)

(52) U.S. Cl. ..... 29/890.051; 29/890.03; 432/90

(58) Field of Classification Search ..... 29/429, 29/890.03, 890.039, 890.051; 34/168, 169; 122/13.1, 493, 13.01; 202/228; 432/14, 90

See application file for complete search history.

(56) References Cited

U.S. PATENT DOCUMENTS 3,848,344 A * 11/1974 Kemmetmueller ..... 202/228
6,588,104 B2 * 7/2003 Heidrich ..... 29/890.051

FOREIGN PATENT DOCUMENTS

| | | | |
|---|---|---|---|
| JP | 05-306802 | * | 11/1993 |
| JP | 7-91603 | A | 4/1995 |
| JP | 8-114302 | A | 5/1996 |
| JP | 8-261405 | A | 10/1996 |
| JP | 11-211003 | A | 6/1999 |
| JP | 2002-098304 | A | 4/2002 |
| JP | 2002-213707 | A | 7/2002 |

* cited by examiner

*Primary Examiner* — Donghai D. Nguyen
(74) *Attorney, Agent, or Firm* — Crowell & Moring LLP

(57) ABSTRACT

An installation construction method is provided for boiler facilities in which the boiler facilities include a boiler building configured of a steel structure, a boiler main unit to be installed within the boiler building, various types of equipment to be installed to the boiler main unit, and accessory members which are accessory thereto. During construction of the boiler building, the various types of equipment and the accessory members are carried into the boiler building and installed.

11 Claims, 29 Drawing Sheets

INSTALLATION CONSTRUCTION METHOD FOR BOILER FACILITIES

BACKGROUND OF THE INVENTION

1. Field of the Invention

The present invention relates an installation construction method for boiler facilities, and particularly relates to an installation construction method for improving work efficiency and safety in the installation of the various types of equipment disposed within a steel structure building and accessory members accessory thereto.

2. Description of the Related Art

FIG. 19 is a schematic configuration diagram of a common boiler facility for electric power production. A boiler main unit 1 is disposed within a boiler building 3 configured of a steel structure 2 around and above, and is suspended from top girders traversing the top of the boiler building 3 by sling bolts.

Secondary air for combustion to the boiler main unit 1 is guided to a furnace combustion chamber with a burner, via a forced draft fan, an air pre-heater 5, a wind box 6, and so on forth. Also, coal fuel transporting air is guided from the air pre-heater 5 to a mill 8 via a primary air duct 7.

Coal to serve as fuel is stored in a bunker 9, and is supplied to the mill 8 while being measured by a stoker 10, and is pulverized to a predetermined particle size. The fine powder coal generated at the mille 8 is supplied to the burner disposed within the wind box 6 through a fuel pipe along with the coal fuel transporting air, and is burned in the furnace combustion chamber.

The hot combustion gas generated by combustion in the furnace combustion chamber is then subjected to heat exchanges within an internal fluid flowing through a secondary superheater 11, a tertiary superheater 12, a reheater 13, a primary superheater 14, an economizer 15, and so on forth, disposed within an air flue of the boiler main unit 1. The combustion gas subjected to heat exchange passes through an economizer discharge gas duct 16, a denitration device, the air pre-heater 5, and an air pre-heater discharge gas duct 17, and is externally discharged from the boiler building 3.

On the other hand, water feed to the boiler main unit 1 is performed by water passing from a condenser outside of the boiler building 3 through a main water pipe to each of the heat exchangers such as the economizer 15, where heat exchange creates high-temperature high-pressure steam, which passes through a main steam pipe and is guided to a high-pressure turbine outside of the boiler building 3.

Steam from a medium-pressure turbine is guided to the reheater 13 via a low-temperature reheating steam pipe, and the reheated steam passes through a high-temperature reheating steam pipe and is guided to a low-pressure turbine outside of the boiler building 3.

FIGS. 20 through 29 are schematic configuration diagrams for describing a conventional boiler facilities installation construction method. In these drawings, FIGS. 21, 23, 25, 27, and 29, are views taken along line A-A in FIGS. 20, 22, 24, 26, and 28, respectively.

As shown in FIGS. 20 and 22, first, a predetermined number of first-level steel columns 21 are erected, and between the first-level steel columns 21 are assembled first floor beams for a floor 22 and second floor beams for a floor 23. Next, as shown in FIGS. 22 and 23, second-level steel columns 24 are erected upon the first-level steel columns 21, and between the second-level steel columns 24 are assembled third floor beams for a floor 25 and fourth floor beams for a floor 26. Next, as shown in FIGS. 24 and 25, third-level steel columns 27 are erected upon the second-level steel columns 24, and between the third-level steel columns 27 are assembled fifth floor beams for a floor 28 and sixth floor beams for a floor 29. Next, as shown in FIGS. 26 and 27, fourth-level steel columns 30 are erected upon the third-level steel columns 27, and between the fourth-level steel columns 30 are assembled seventh floor beams for a floor 31, eighth floor beams for a floor 32, and top girders 33, thereby completing construction of the boiler building 34.

Subsequently, as shown in FIGS. 28 and 29, the top girders 33 are used to suspend the boiler main unit 35 from the top of the boiler building 34. Also, ducts 36, a bunker 37, stoker 38, fuel pipes 39, soot blower 40, various types of piping, cable tray 41, railing, electric panel, and so on forth, are carried into the boiler building 34 from the sides, by crane, temporary monorail, chain hoist, and so on forth, and positioned and welded into plate, thereby completing installation of the boiler facilities.

With the conventional boiler facility installation construction method, the series of work from manufacturing the steel beams to installation on-site to construct the boiler building has been performed by a steel fabrication manufacturer. The ducts, bunker, stoker, fuel pipes, soot blower, various types of piping, cable tray, railing, electric panel, and so on forth, to be installed in the boiler building have been carried in and installed following completion of the boiler building.

Boiler facility installation construction methods are described in, for example, Japanese Unexamined Patent Application Publication No. 07-091603, Japanese Unexamined Patent Application Publication No. 08-114302, Japanese Unexamined Patent Application Publication No. 08-261405, Japanese Unexamined Patent Application Publication No. 11-211003, Japanese Unexamined Patent Application Publication No. 2002-098304, and Japanese Unexamined Patent Application Publication No. 2002-213707.

With such conventional boiler facility installation construction methods, ducts, bunker, stoker, fuel pipes, soot blower, various types of piping, cable tray, railing, various types of electric equipment such as electric panels, and so on forth, and accessory members accessory thereto, were carried in and installed following completion of the boiler building.

Accordingly, ducts, piping, and the like, were carried into the boiler building from the side thereof as duct panels, piping pieces, and so on forth, in relatively small sizes, to facilitate carrying into the assembled boiler building, by crane, temporary monorail, chain hoist, and so forth.

This means that the work of carrying in and installing various types of equipment and accessories is concentrated in the period following completion of the boiler building, leading to problems in that all work regarding ducts, piping, and so forth, is high-place work, meaning deterioration in work capability, and in that work within a limited space means work is restricted, requiring a longer construction schedule, and further that the amount of high-risk work at high places is great, leading to higher construction costs, and increased risk of workplace accidents.

Also, with arrangements wherein multiple members are combined to form a unit, and these are hoisted above the installation location using a crane and the lower for installation, already-assembled beams and columns and the like tend to interfere with carrying in and installing the units.

SUMMARY OF THE INVENTION

The present invention has been made to solve the aforementioned shortcomings of conventional methods, and accordingly, it is an object of the present invention thereof to provide an installation construction method for boiler facilities with high work efficiency.

According to an aspect of the present invention, with an installation construction method for boiler facilities in which the boiler facilities include a boiler building configured of a steel structure, a boiler main unit to be installed within the boiler building, various types of equipment to be installed to the boiler main unit, and accessory members which are accessory thereto; during construction of the boiler building, the various types of equipment and the accessory members are carried into the boiler building and installed.

Floor units, having at least floor beams and a floor, assembled beforehand within a hoisting limit load of a crane, may be carried in and installed in parallel with construction of the boiler building.

Tie-ins for tying in to tie-in portions of the boiler building may be provided to the floor units.

A duct block, having at least a duct casing panel, internal support, and a damper, assembled beforehand within a hoisting limit load of a crane, may be carried in and installed in parallel with construction of the boiler building.

Thermal insulation and cladding sheets may be installed to the duct block beforehand.

A fuel pipe block, having at least a fuel pipe and a supporting device thereof, assembled beforehand within a hoisting limit load of a crane, may be carried in and installed in parallel with construction of the boiler building.

Piping, fabricated so as to be within a length to allow for transportation from factory to the site, is carried in and installed in parallel with construction of the boiler building.

A piping skid, integrally linking at least piping and a valve, may be carried in and installed in parallel with construction of the boiler building.

A bunker block, in which component parts of a bunker are assembled in a ring-like form beforehand within a hoisting limit load of a crane, may be carried in and installed in parallel with construction of the boiler building.

A floor unit integral article, configured by the floor unit and at least one of the various types of equipment and accessory members accessory thereto being assembled beforehand within a hoisting limit load of a crane, may be carried in and installed in parallel with construction of the boiler building.

The boiler building may be constructed in the shape of a box with one side opened when viewed from above so that one side of the boiler building forms an opening, with the boiler main unit being placed inside the boiler building through the opening and installed therein.

With the present invention, as described above, the various types of equipment and accessory members to be installed within the boiler building are carried in and installed while building the boiler building, so the columns and beams of the boiler building pose little obstruction, and accordingly the various types of equipment and accessory members can be easily carried in an installed. Also, construction of the boiler building and carrying in and installation of the various types of equipment and accessory members are performed in parallel, thereby improving work efficiency.

Moreover, a great part of the various types of equipment and accessory members to be installed within the boiler building can be assembled near the ground rather than at high places, and can be directly assembled by crane as with the steel structure, so work safety can be improved, and costs can be reduced due to standardization of work amount during the construction schedule and improved work efficiency.

DESCRIPTION OF THE PREFERRED EMBODIMENTS

Next, an embodiment of the present invention will be described, with reference to the drawings. FIGS. 1 through 10 are schematic configuration diagrams for describing the boiler facilities installation construction method according to the present embodiment. In these drawings, FIGS. 2, 4, 6, 8, and 10, are views taken along line A-A in FIGS. 1, 3, 5, 7, and 9, respectively. Also, FIGS. 11 through 18 are perspective views illustrating the state at the time of installing the boiler facilities.

Figure 1:
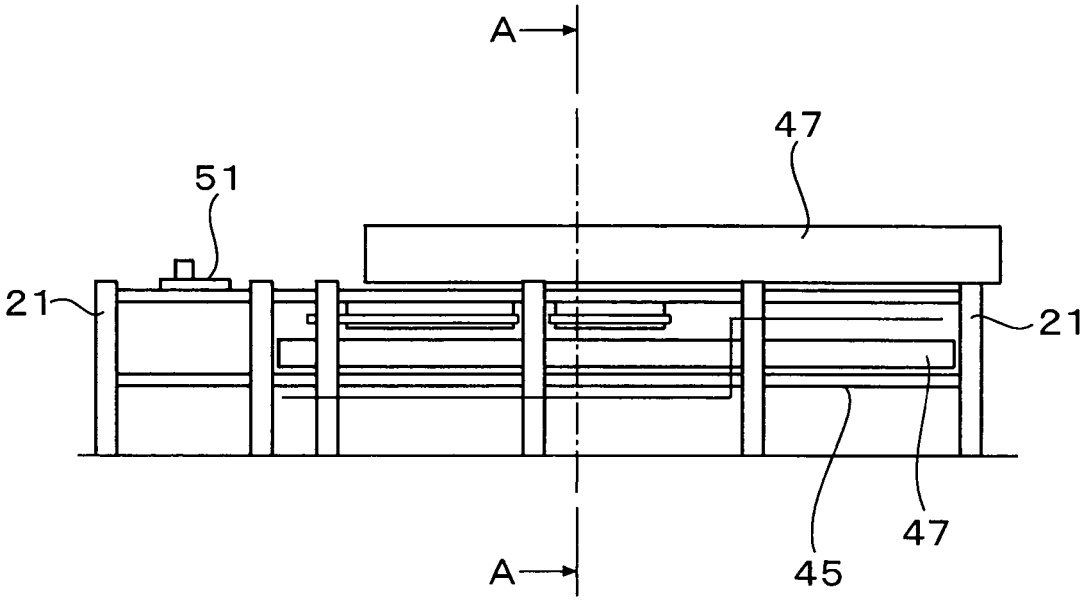
FIG. 1 is a schematic configuration diagram for describing the boiler facilities installation construction method according to an embodiment of the invention.
Figure 2:
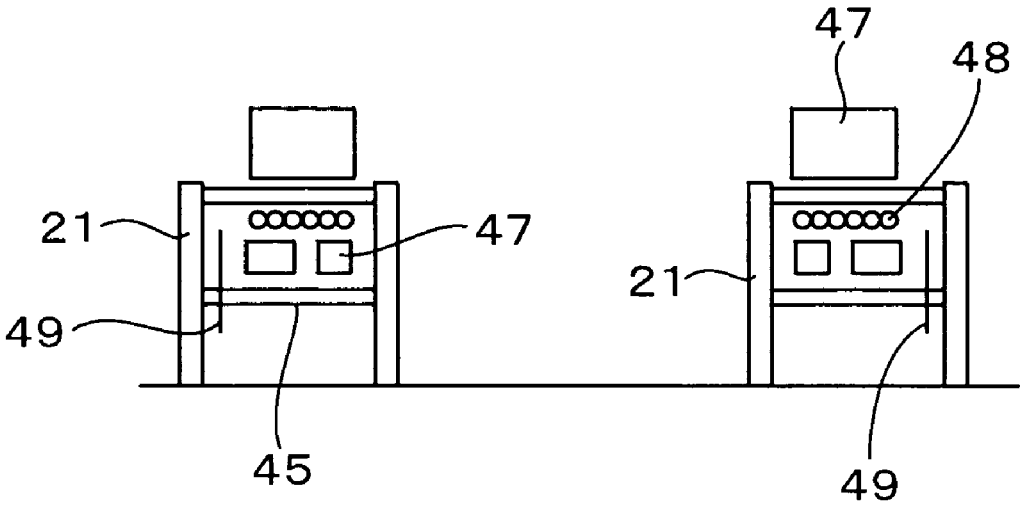
FIG. 2 is a view taken along line A-A in FIG. 1.
Figure 11:
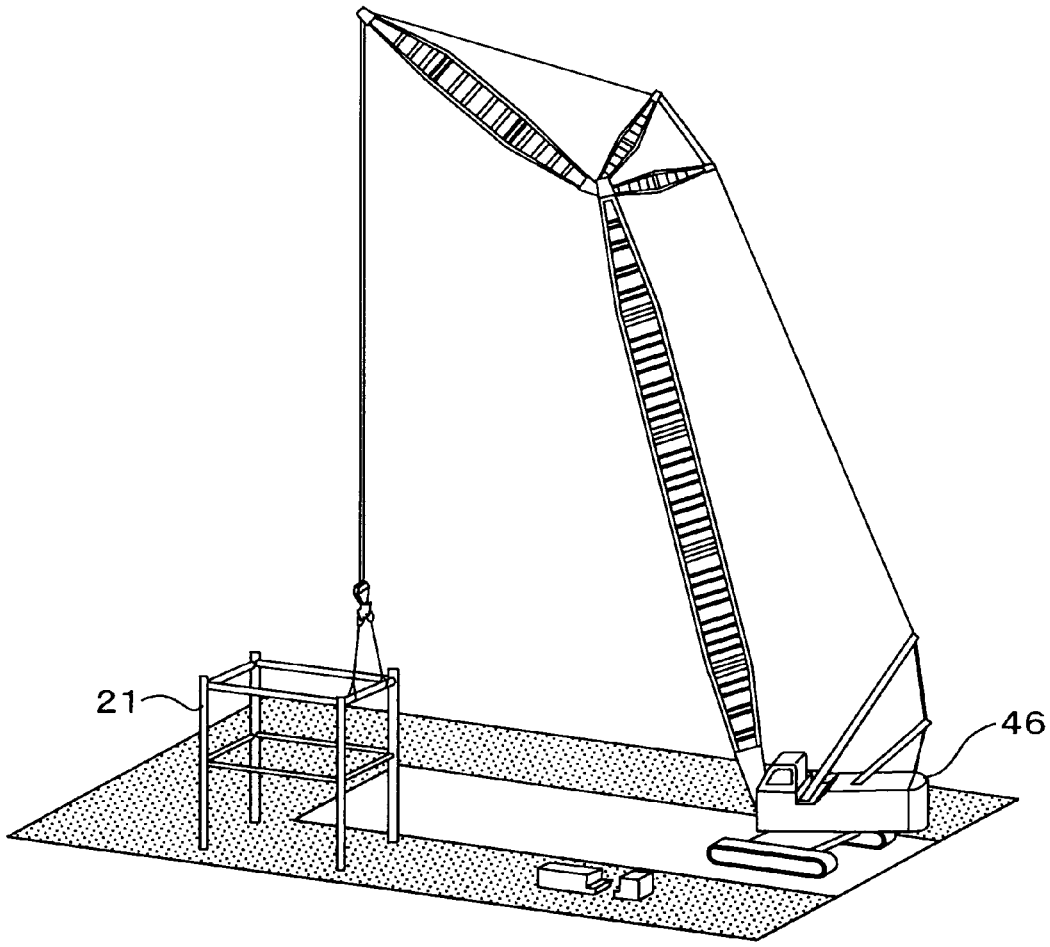
FIG. 11 is a perspective view illustrating the state of installing the boiler facilities according to the embodiment.

First, as shown in FIGS. 1 and 2, a predetermined number of first-level steel columns 21 are assembled, and in conjunction therewith, a first floor unit 45 is disposed between the first-level steel columns 21. FIG. 11 illustrates the state of assembling the first-level steel columns 21 by a crane 46.

The steel structure is made up of columns and beams, which are fastened at the joints thereof with, for example, L-shaped fasteners and bolts. The columns are vertically divided in to multiple sections, and are assembled on-site for use. Floors are laid on steel beams, and are configured of floor beams, grating, checker plate, or the like, each fixed by welding.

A floor unit has at least floor beams and a floor, and has been assembled beforehand, taking the hoisting limit load of the crane into consideration. Tie-ins are provided to the floor unit to facilitating tying in with the steel beams and columns. The tie-ins are used to dispose the floor units between the steel columns on each level.

A duct block 47, fuel block 48, cable tray 49, mill, and so forth, are carried in above the first floor unit 45, and installed. The duct block 47, fuel block 48, and cable tray 49 may be carried in separately from or together with the first floor unit 45. For example, an arrangement wherein the floor unit 45 and the duct block 47 are integrally formed and carried in, or wherein the floor unit 45 and the fuel block 48 are integrally formed and carried in, would have greater work efficiency.

Forming blocks such as the duct block 47 or the fuel block 48, and integration thereof with the floor unit 45, are performed nearby the installation site, or in a plant.

Rectangular ducts are formed of casing in a box shape, with supports provided inside the ducts and thermal insulation and cladding sheets on the outside, and dampers and expansion joints provided along the way. Round ducts are formed of casing in a cylindrical shape, with thermal insulation and cladding sheets on the outside, and expansion joints provided along the way.

The duct block 47 has at least duct casing panels, internal supports, and dampers, and is configured beforehand in a block form so as to be within the hoisting limit load of the crane.

Fuel pipes are configured of straight piping, bent piping, joints for connection thereof, and supports for supporting these with the steel structure. The fuel block 48 has at least fuel pipes and supporting devices (supporting members) thereof, and is configured beforehand in a block form so as to be within the hoisting limit load of the crane.

Figure 12:
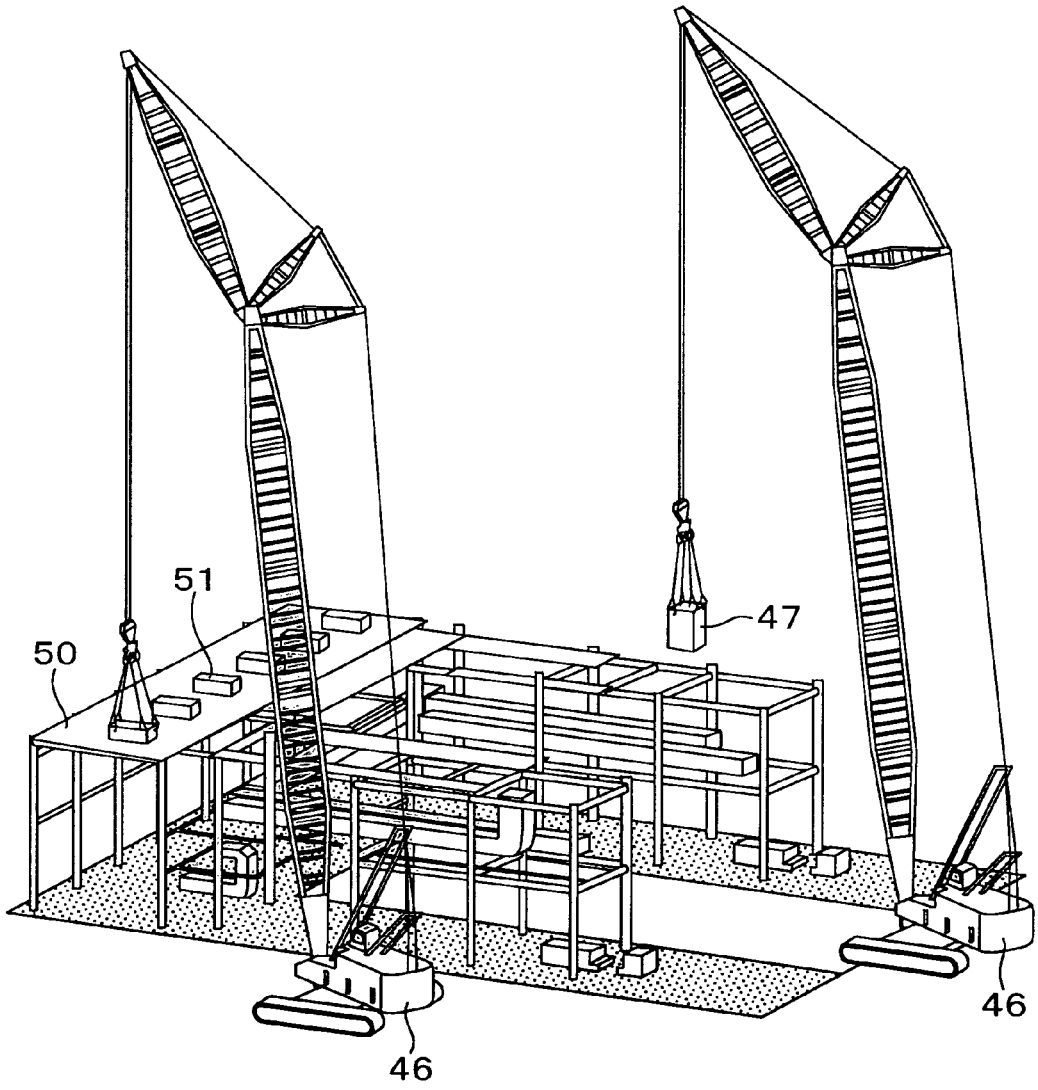
FIG. 12 is a perspective view illustrating the state of installing the boiler facilities according to the embodiment.

A second floor unit 50 is assembled above the first floor unit 45, with a duct block 47 and stoker 51 being carried in an attached. FIG. 12 illustrates the duct block 47 and stoker 51 being installed using multiple cranes 46.

Figure 3:
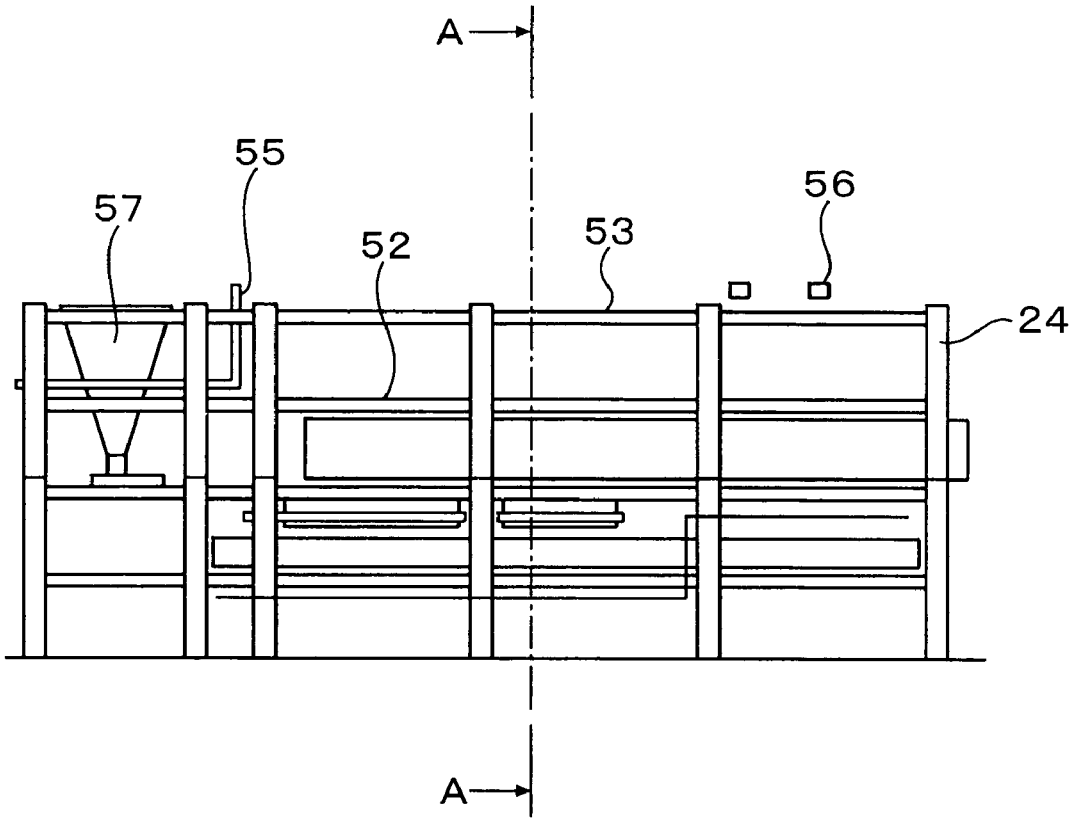
FIG. 3 is a schematic configuration diagram for describing the boiler facilities installation construction method according to an embodiment of the invention.
Figure 4:
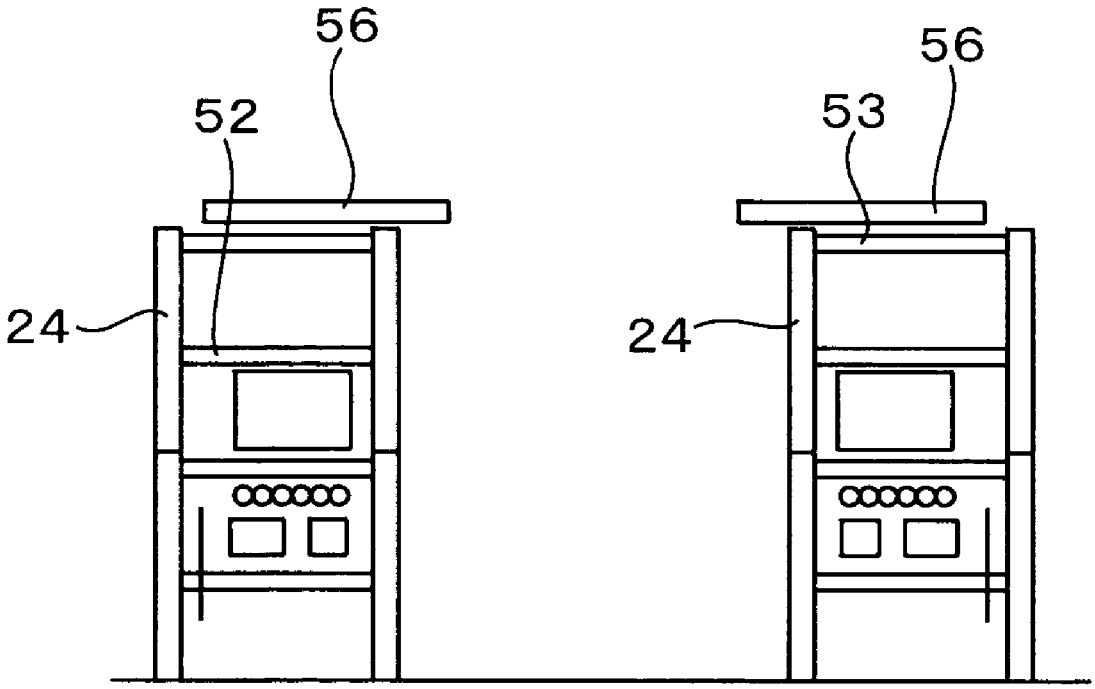
FIG. 4 is a view taken along line A-A in FIG. 3.

Next, as shown in FIGS. 3 and 4, second-level steel columns 24 are erected, with a third floor unit 52 and fourth floor unit 53 being disposed between the second-level steel columns 24, and also a bunker cone block 57, piping 55, soot blower 56, and so forth, being carried in and installed.

The bunker block 54 (the bunker cone block 57 and later-described bunker cylinder block 60) has been assembled beforehand in a ring-like form, taking the hoisting limit load of the crane into consideration.

The piping 55 is in a long shape, fabricated so as to be within a length that would allow for transportation between the factory and the site.

Figure 13:
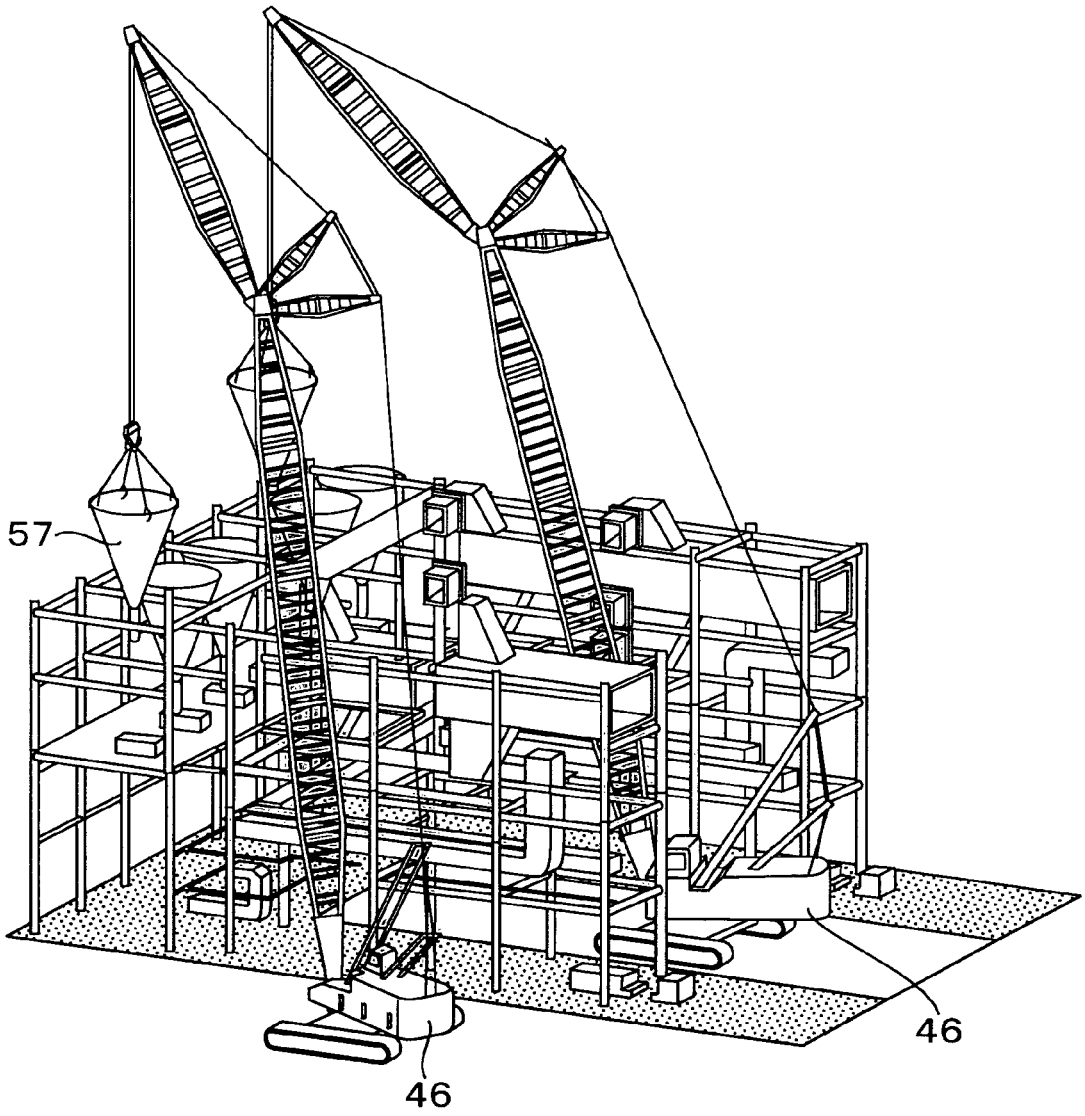
FIG. 13 is a perspective view illustrating the state of installing the boiler facilities according to the embodiment.

FIG. 13 illustrates the state of installing the bunker cone block 57 using multiple cranes 46. The boiler building 34 is in the shape of a box with one side opened when viewed from above until the boiler main unit 34 is strung within, so cranes 46 can enter the inside of the boiler building 34 being built as shown in the drawing, and can carry in equipment such as the bunker cone block 57 and so forth.

Figure 5:
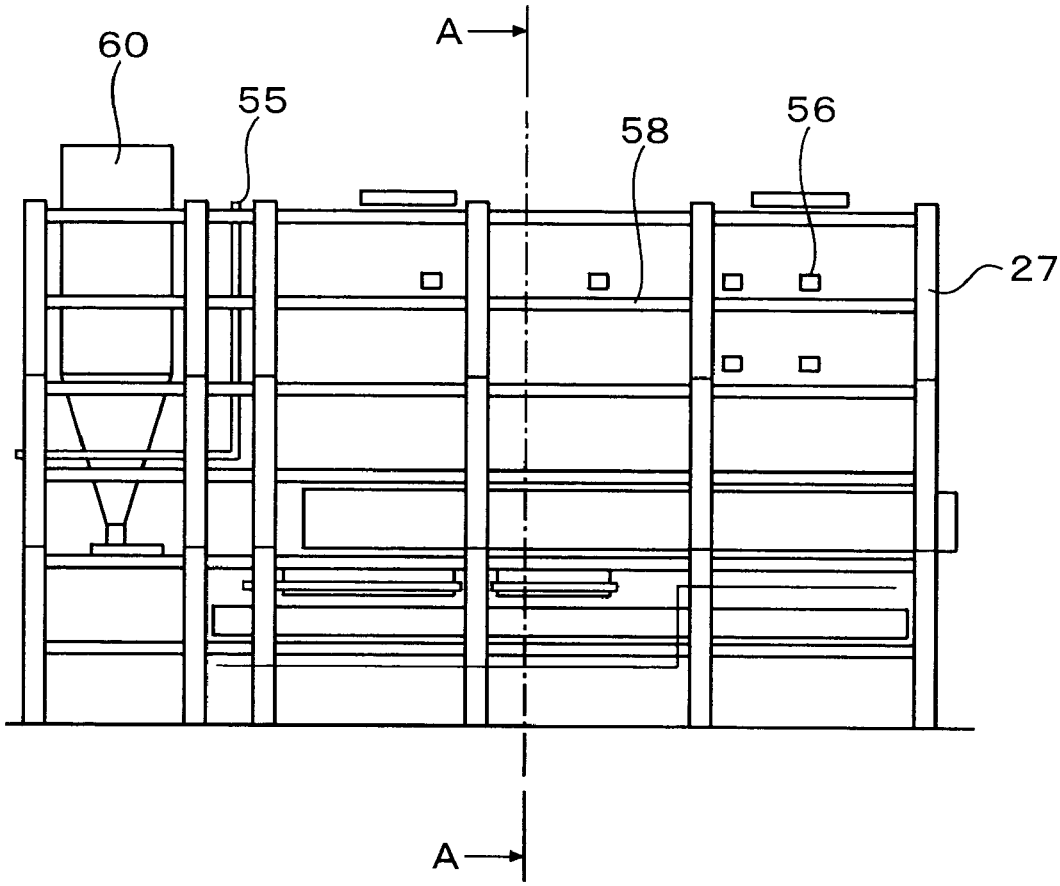
FIG. 5 is a schematic configuration diagram for describing the boiler facilities installation construction method according to an embodiment of the invention.
Figure 6:
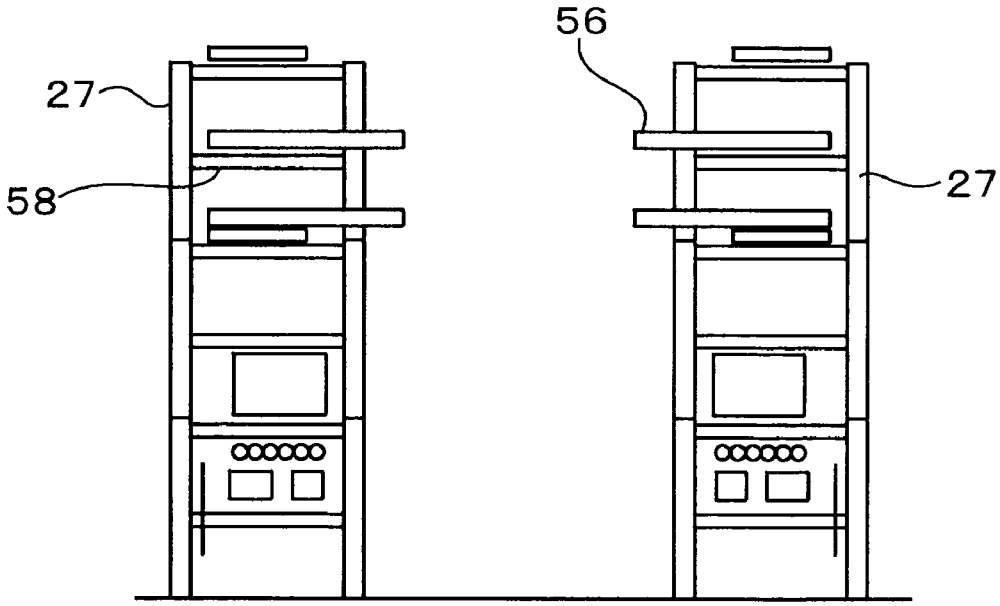
FIG. 6 is a view taken along line A-A in FIG. 5.

Next, as shown in FIGS. 5 and 6, third-level steel columns 27 are erected, with a fifth floor unit 58 being disposed between the third-level steel columns 27, and also piping 55, soot blower 56, and so forth, being carried in and installed.

A sixth floor unit 59 is assembled above the fifth floor unit 58, with a piping skid and bunker cylinder block 60 and the like being carried in and installed. The piping skid is configured of integrally linking at least piping and valves.

Figure 14:
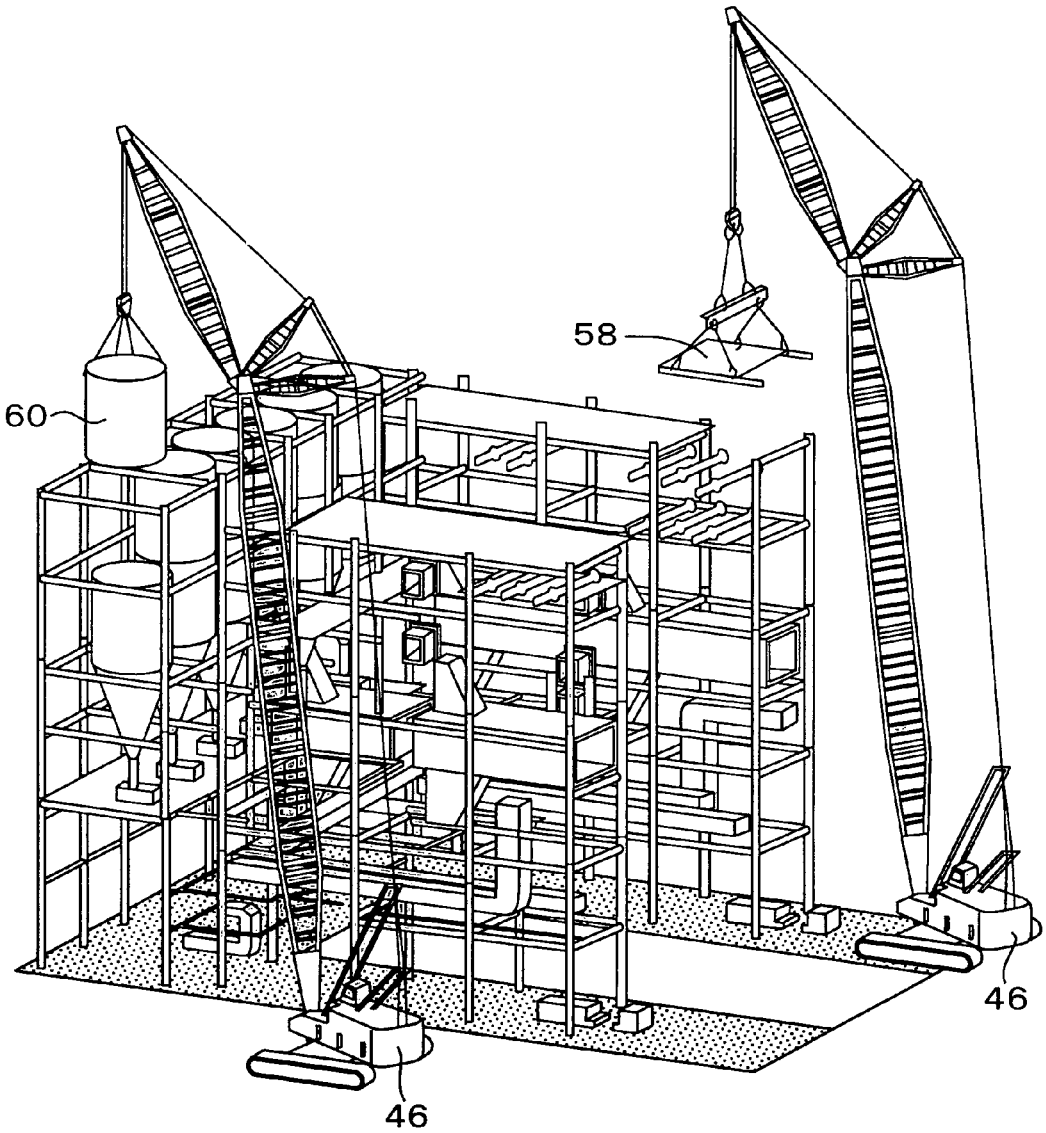
FIG. 14 is a perspective view illustrating the state of installing the boiler facilities according to the embodiment.

FIG. 14 illustrates the bunker cylinder block 60 being installed using multiple cranes 46. At another place, a fifth floor unit 58 is being installed using a crane 46.

Figure 7:
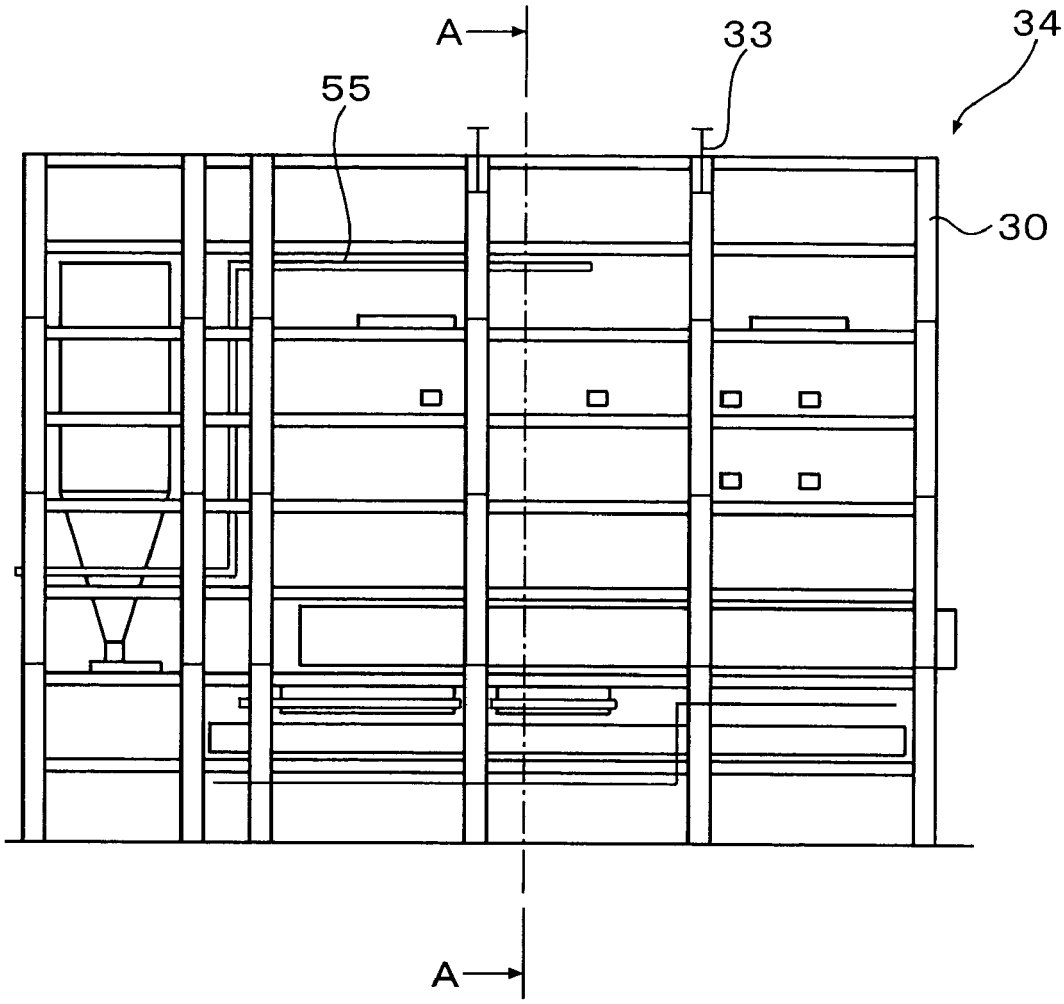
FIG. 7 is a schematic configuration diagram for describing the boiler facilities installation construction method according to an embodiment of the invention.
Figure 8:
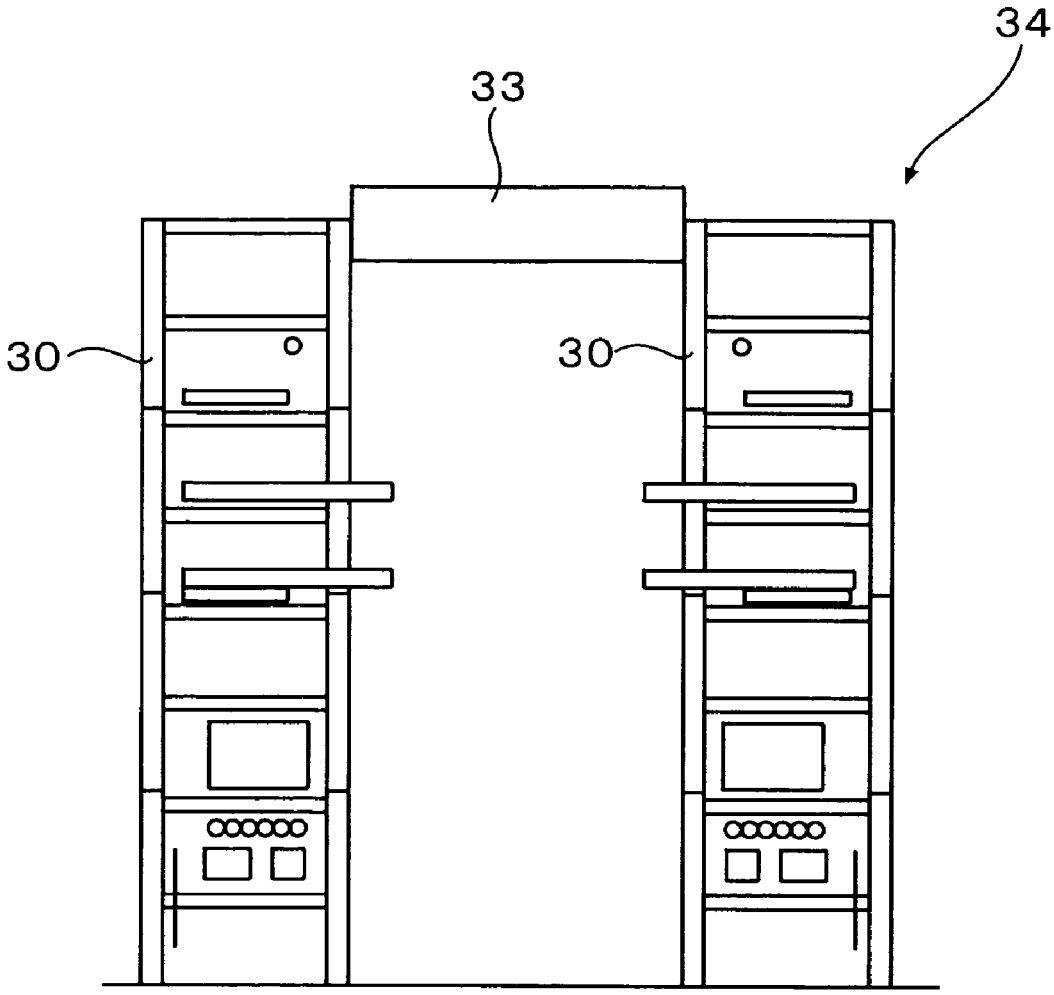
FIG. 8 is a view taken along line A-A in FIG. 7.

Next, as shown in FIGS. 7 and 8, fourth-level steel columns 30 are erected, and following piping 55 and the like being carried in and installed, a seventh floor unit 61 and eighth floor unit 62 are disposed between the fourth-level steel columns 30, and also top girders 33 and the like are carried in and installed.

Figure 15:
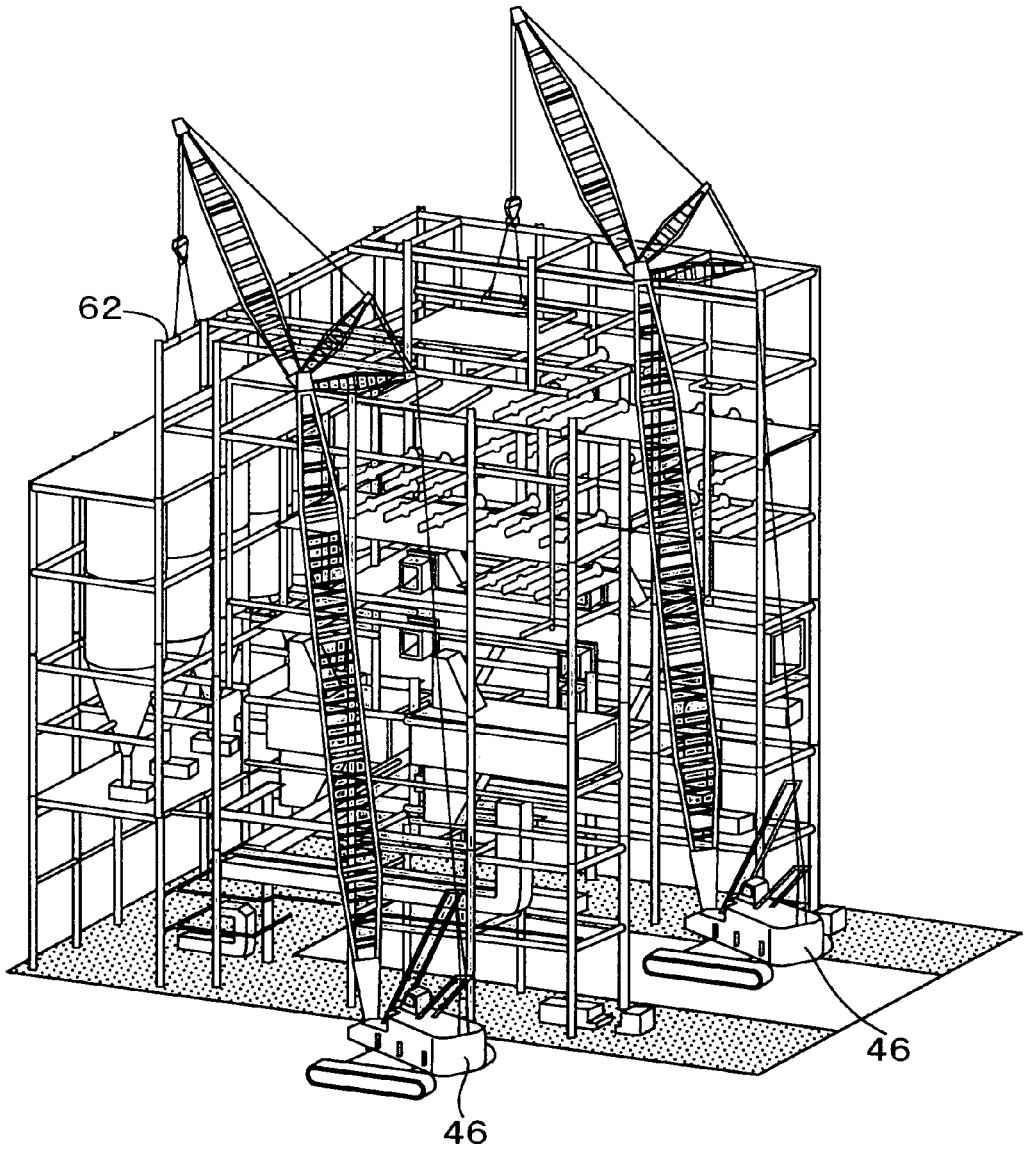
FIG. 15 is a perspective view illustrating the state of installing the boiler facilities according to the embodiment.
Figure 16:
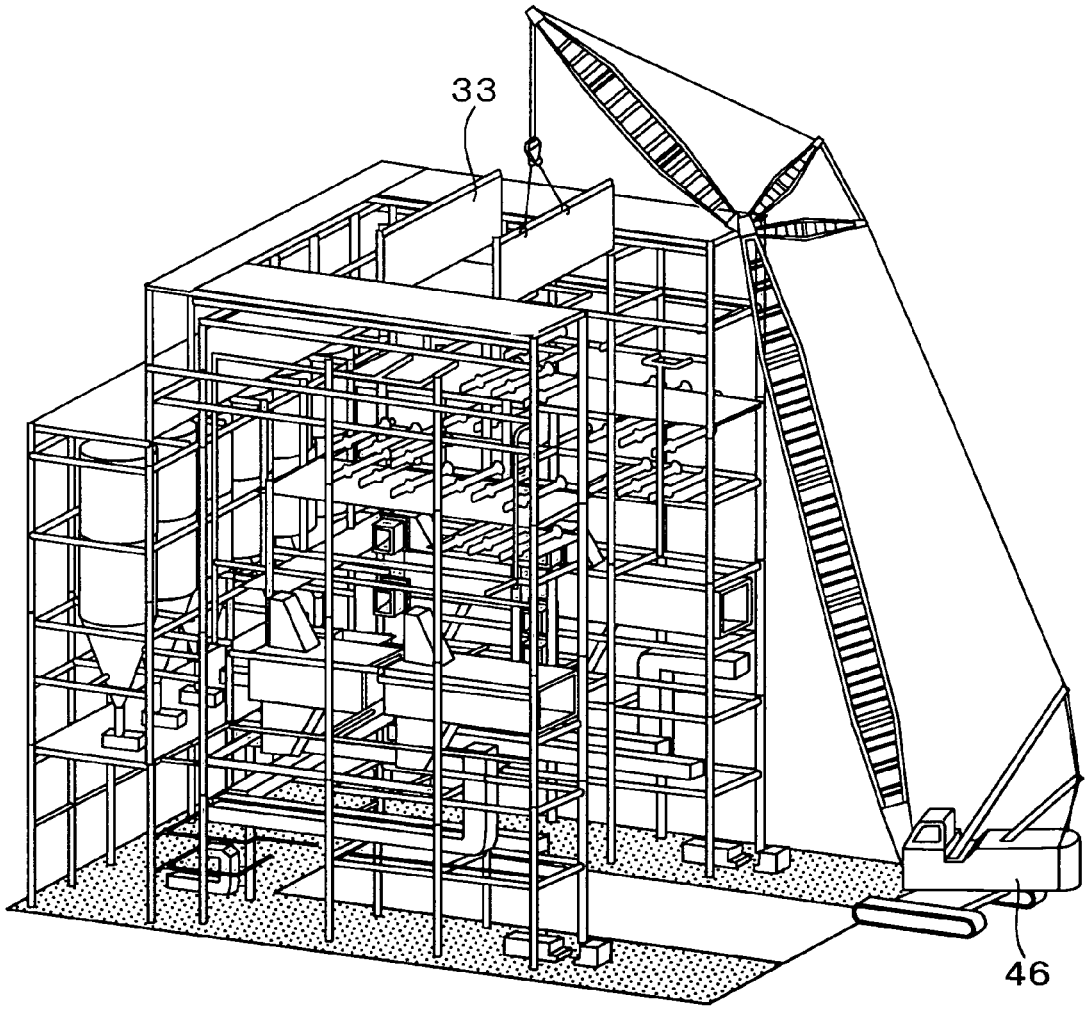
FIG. 16 is a perspective view illustrating the state of installing the boiler facilities according to the embodiment.
Figure 17:
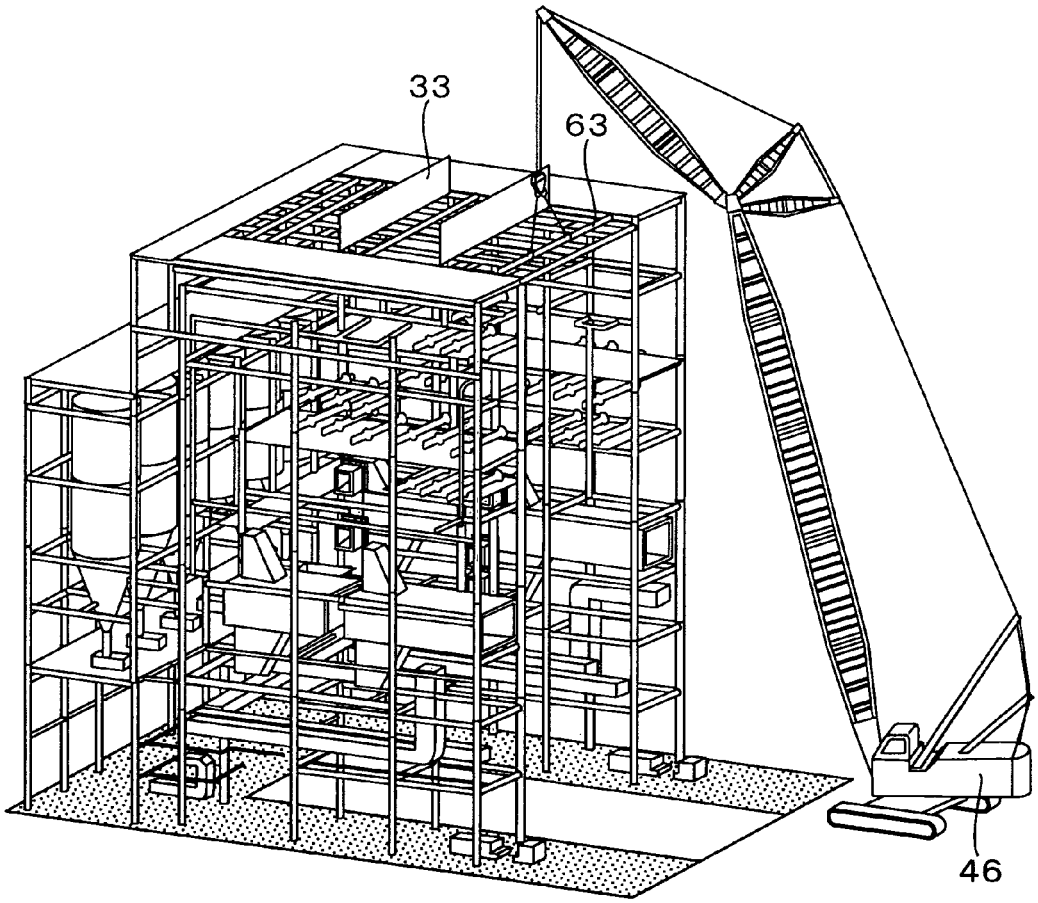
FIG. 17 is a perspective view illustrating the state of installing the boiler facilities according to the embodiment.

FIG. 15 illustrates a state of using a crane 46 to install the floor beams of the eighth floor unit 62, while installing piping 55 with another crane 46. FIG. 16 illustrates a state of using a crane 46 to install the top girders 33, and FIG. 17 illustrates a state of installing ceiling beams 63 near the top girders 33. Thus, construction of almost all of the boiler building 34 is completed, and also, carrying in and installation of almost all of the equipment to the boiler building 34 is completed.

Figure 9:
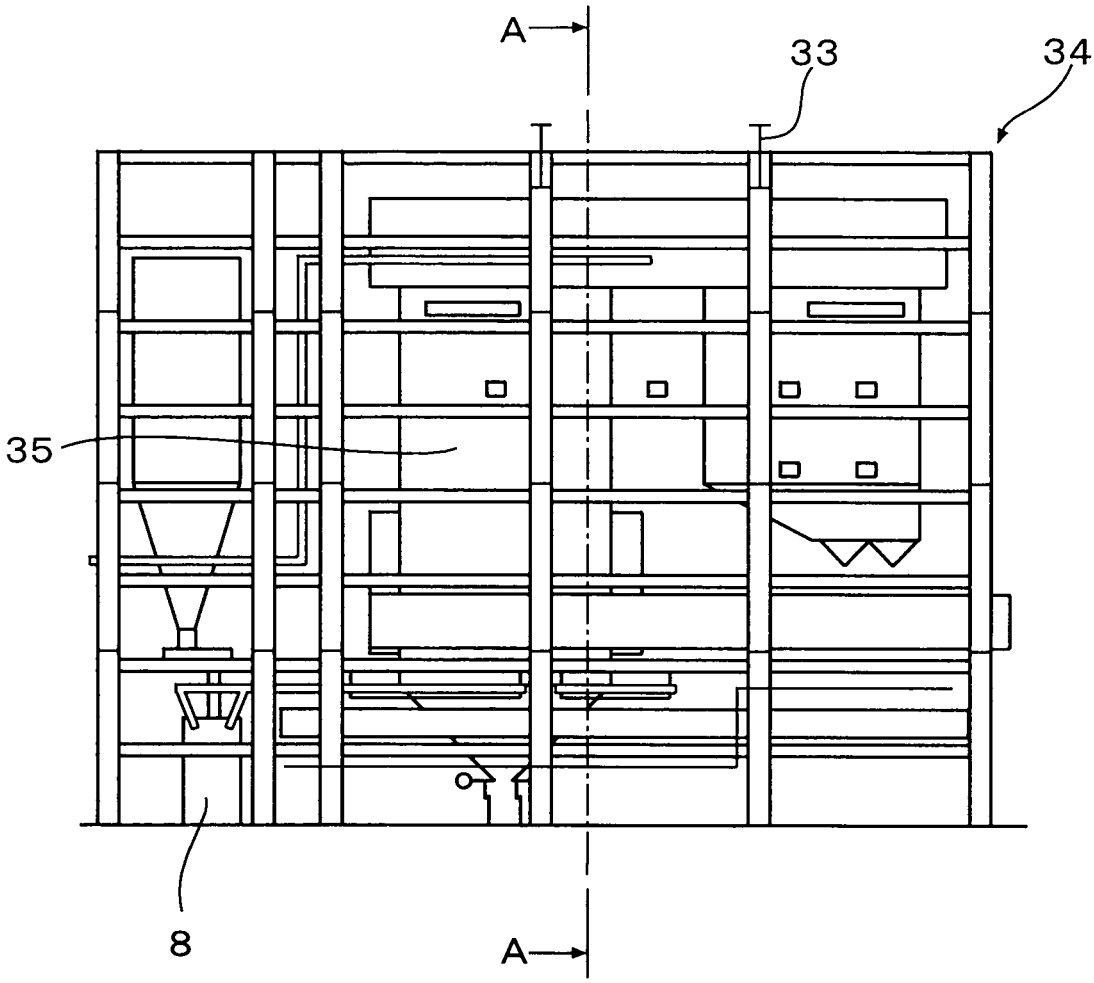
FIG. 9 is a schematic configuration diagram for describing the boiler facilities installation construction method according to an embodiment of the invention.
Figure 10:
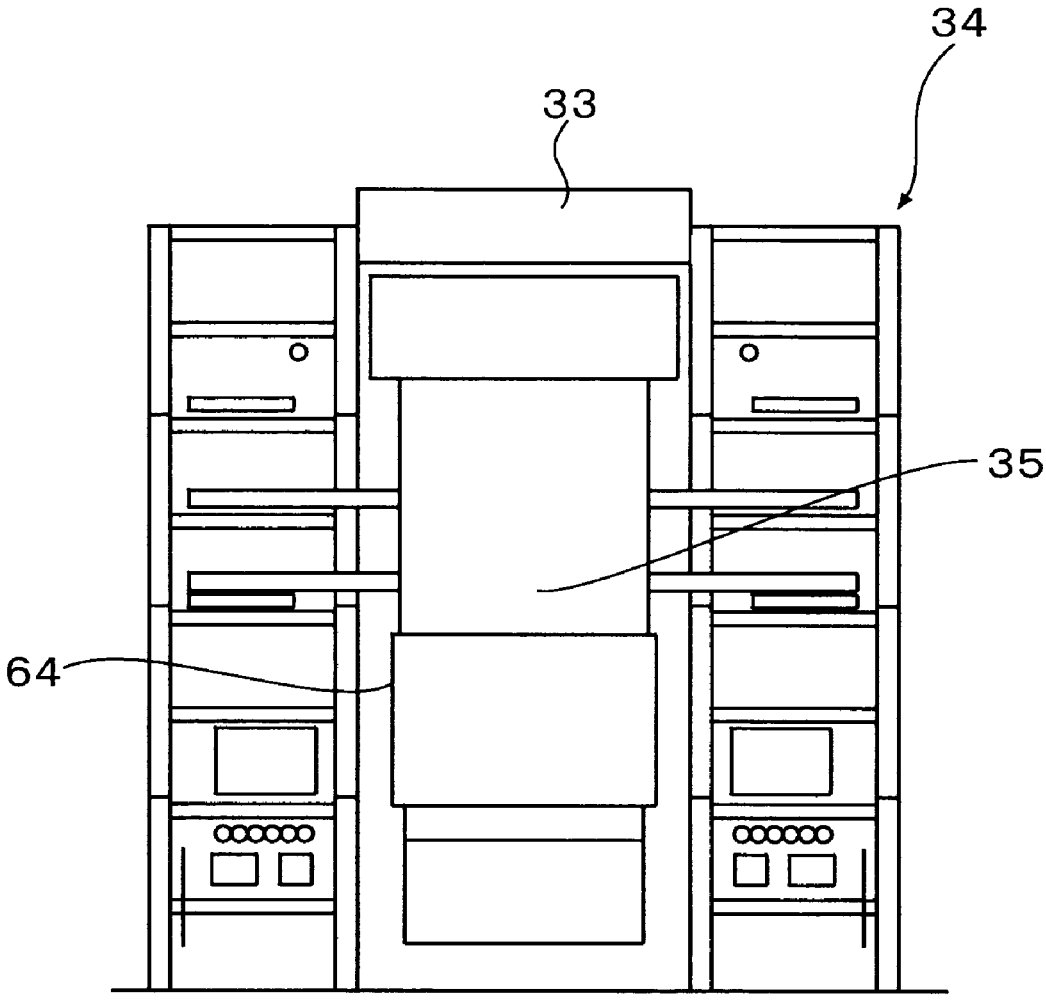
FIG. 10 is a view taken along line A-A in FIG. 9.

As shown in FIGS. 9 and 10, the boiler main unit 35 is inserted from a rear opening portion 64 of the boiler building 34 (see FIG. 10), the boiler main unit 35 is jacked up to a predetermined height using jacks, and is suspended from the top girders 33 by sling bolts. Other equipment and accessories and the like which could not be carried in parallel to construction of the boiler building 34 can be carried in and installed following completion of the construction of the boiler building 34.

Figure 18:
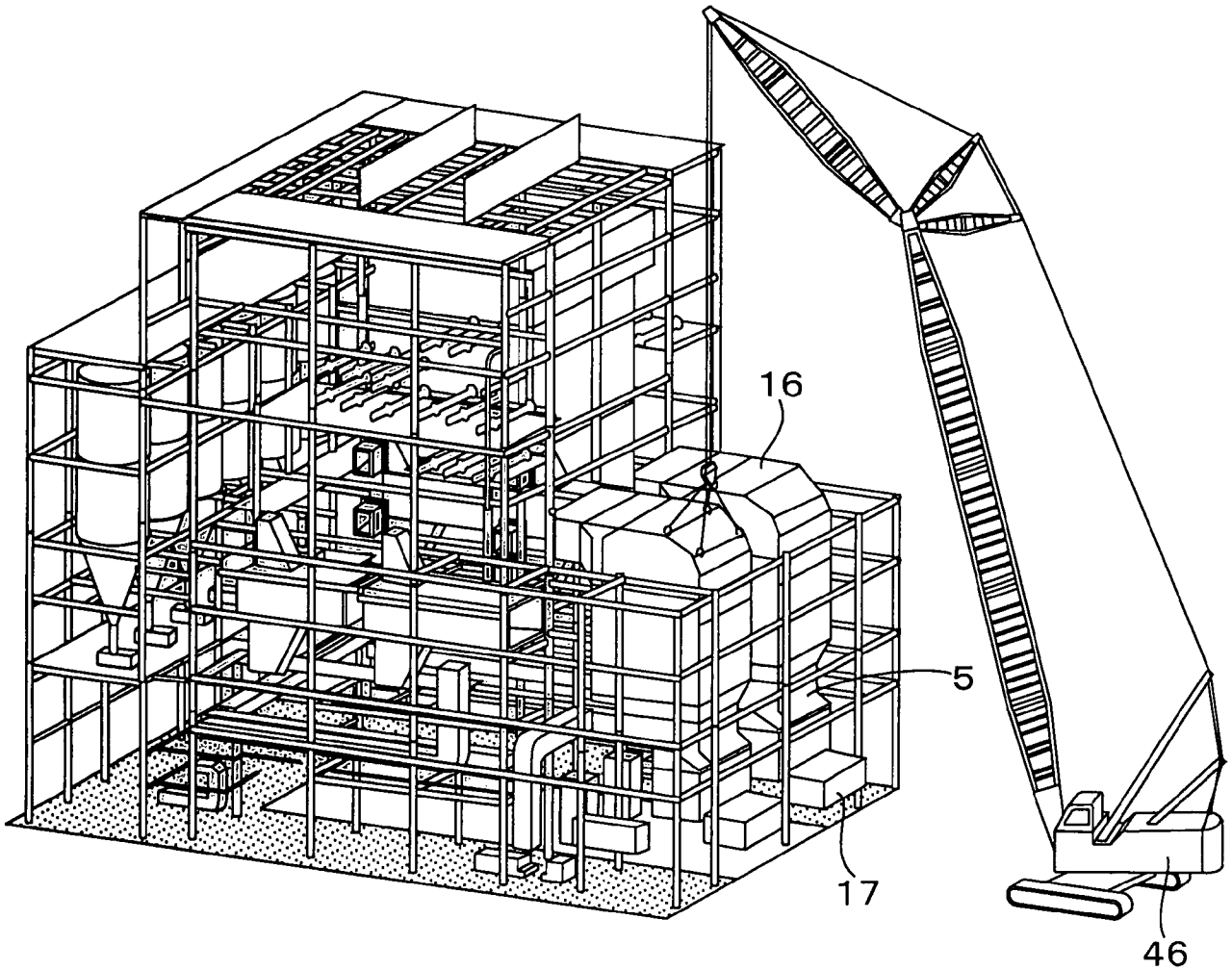
FIG. 18 is a perspective view illustrating the state of installing the boiler facilities according to the embodiment.
Figure 19:
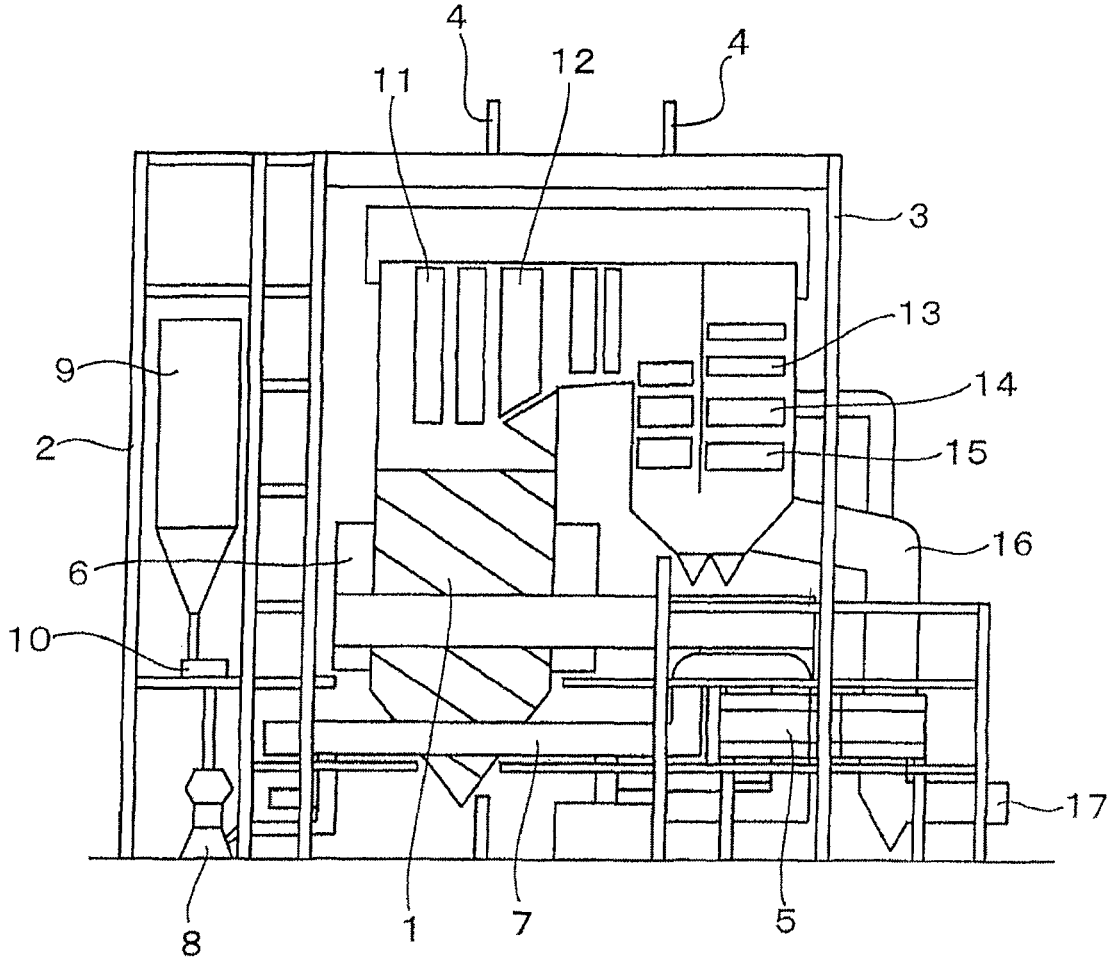
FIG. 19 PRIOR ART
FIG. 19 is a schematic configuration diagram of the boiler facilities.
Figure 20:
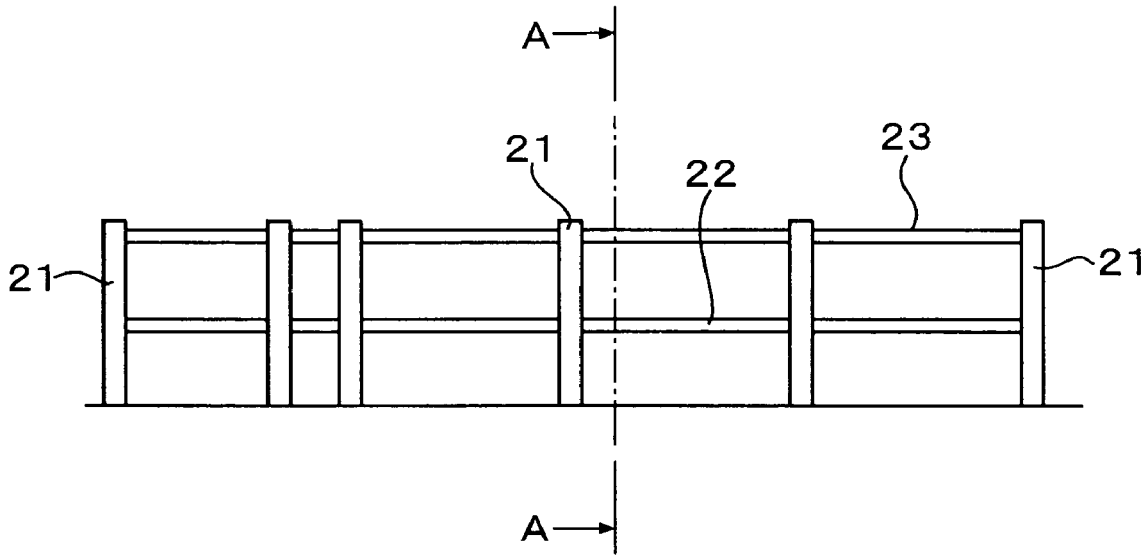
FIG. 20 PRIOR ART
FIG. 20 is a schematic configuration diagram for describing a conventional boiler facilities installation construction method.
Figure 21:
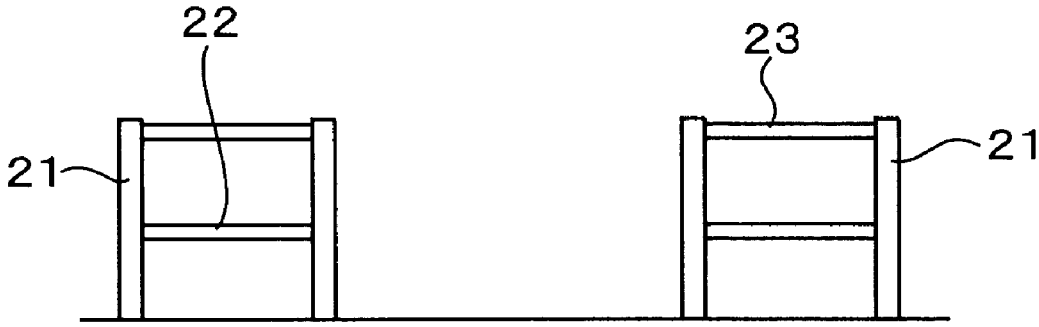
FIG. 21 PRIOR ART
FIG. 21 is a view taken along line A-A in FIG. 20.
Figure 22:
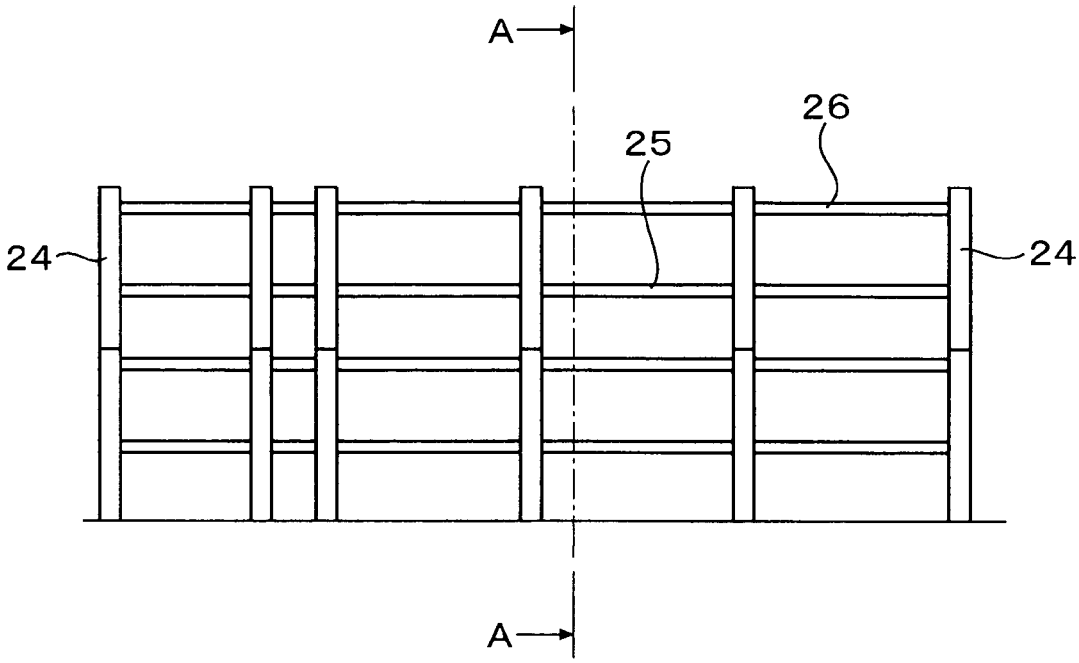
FIG. 22 PRIOR ART
FIG. 22 is a schematic configuration diagram for describing a conventional boiler facilities installation construction method.
Figure 23:
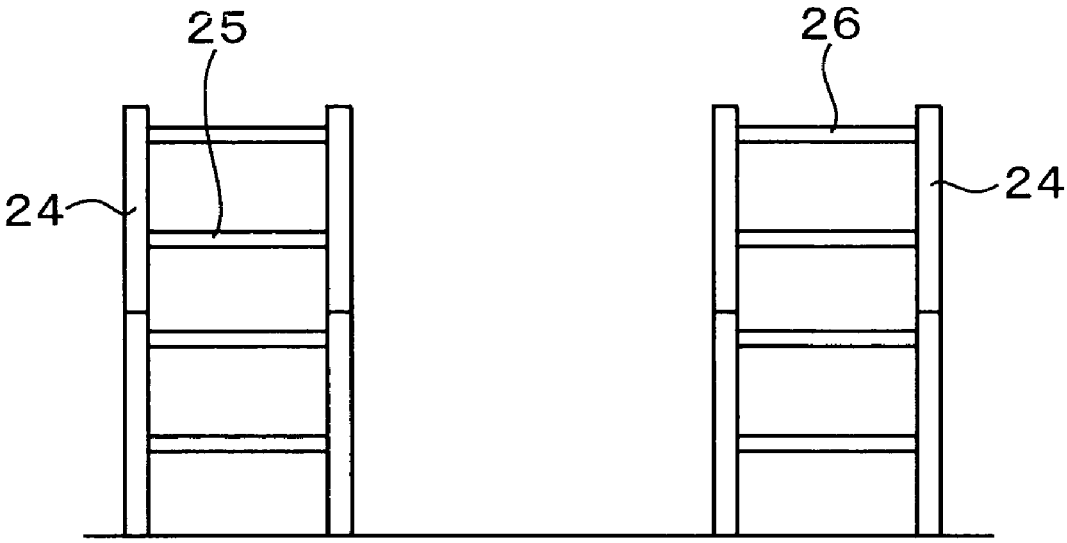
FIG. 23 PRIOR ART
FIG. 23 is a view taken along line A-A in FIG. 22.
Figure 24:
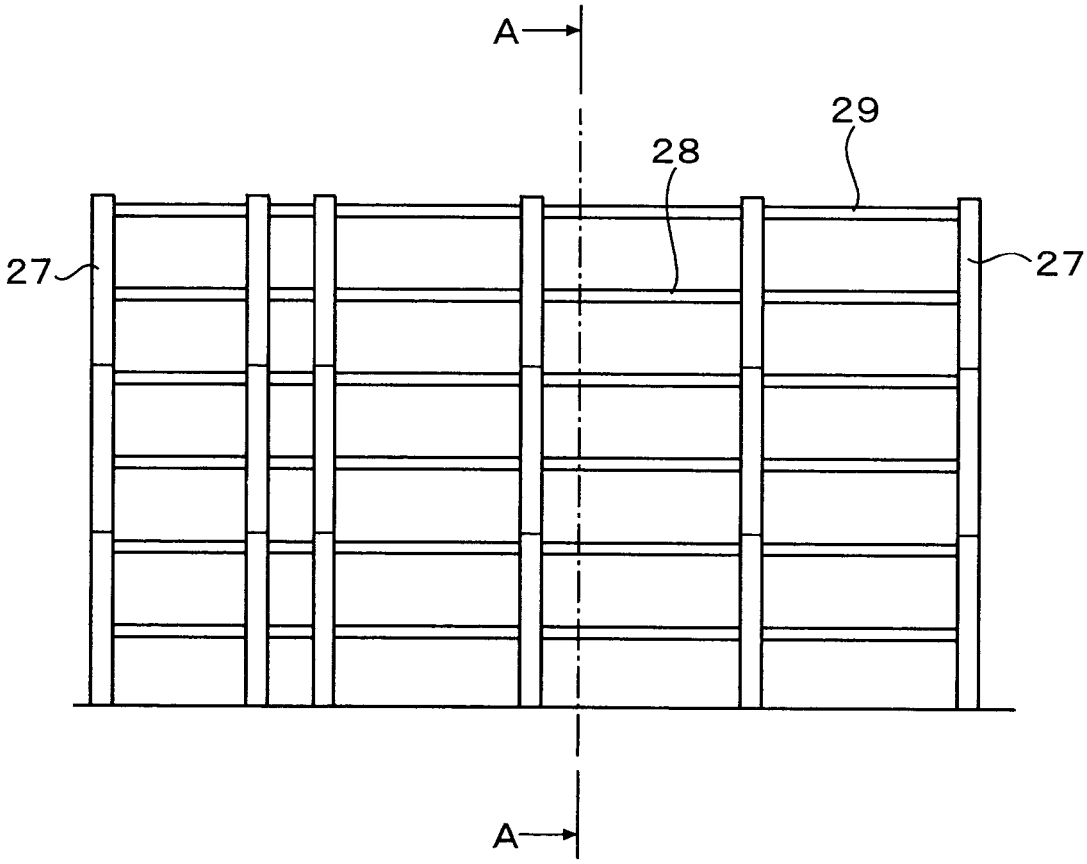
FIG. 24 PRIOR ART
FIG. 24 is a schematic configuration diagram for describing a conventional boiler facilities installation construction method.
Figure 25:
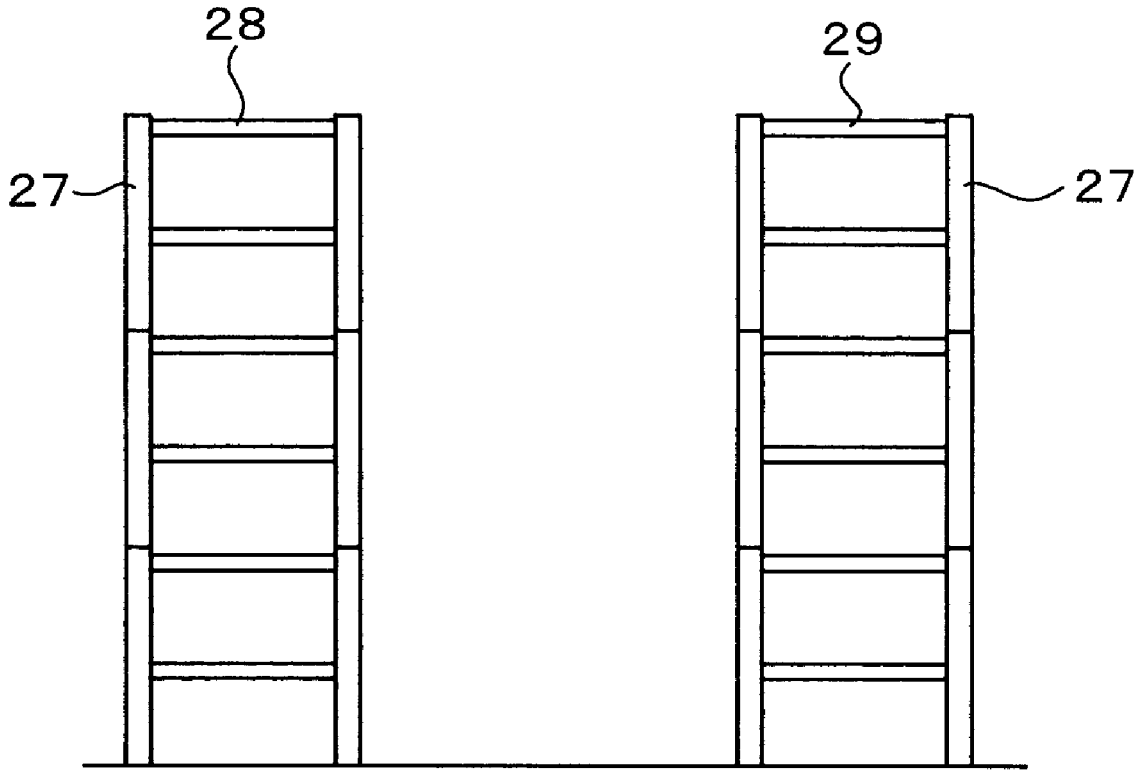
FIG. 25 PRIOR ART
FIG. 25 is a view taken along line A-A in FIG. 24.
Figure 26:
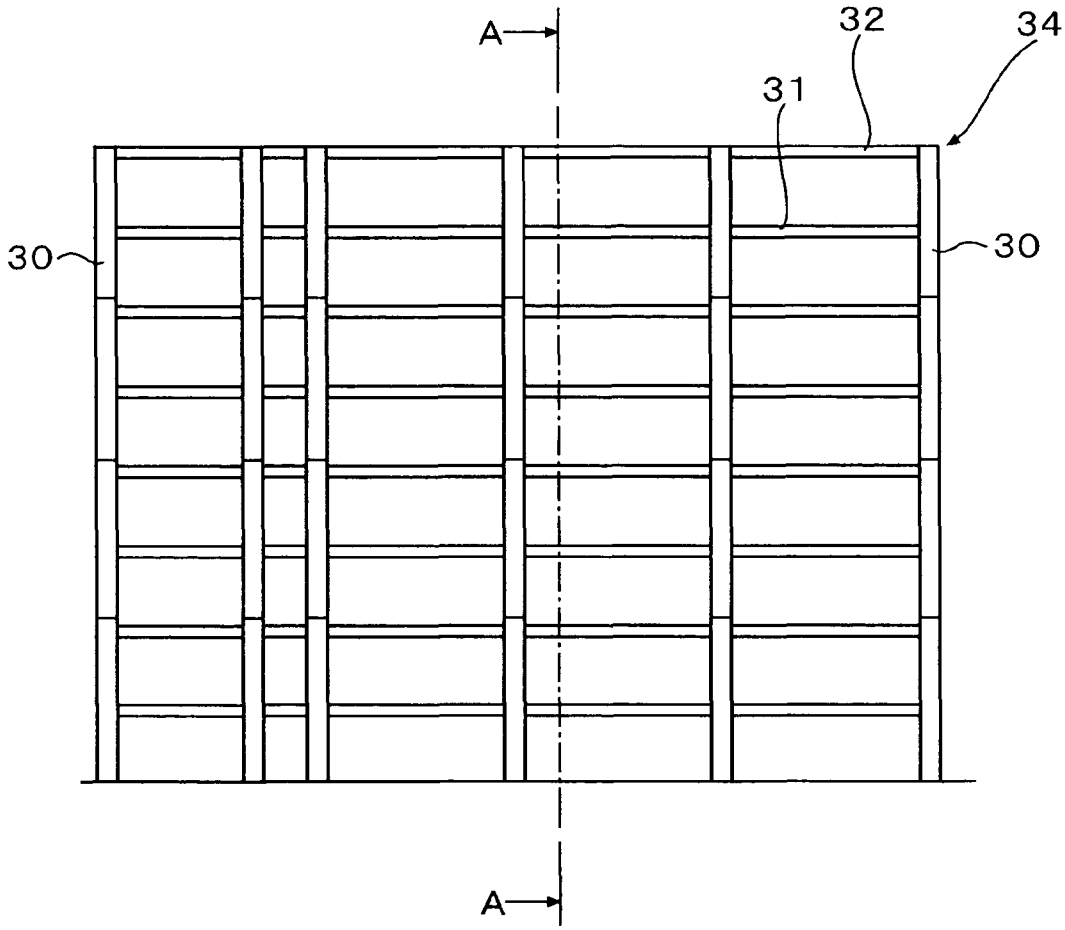
FIG. 26 PRIOR ART
FIG. 26 is a schematic configuration diagram for describing a conventional boiler facilities installation construction method.
Figure 27:
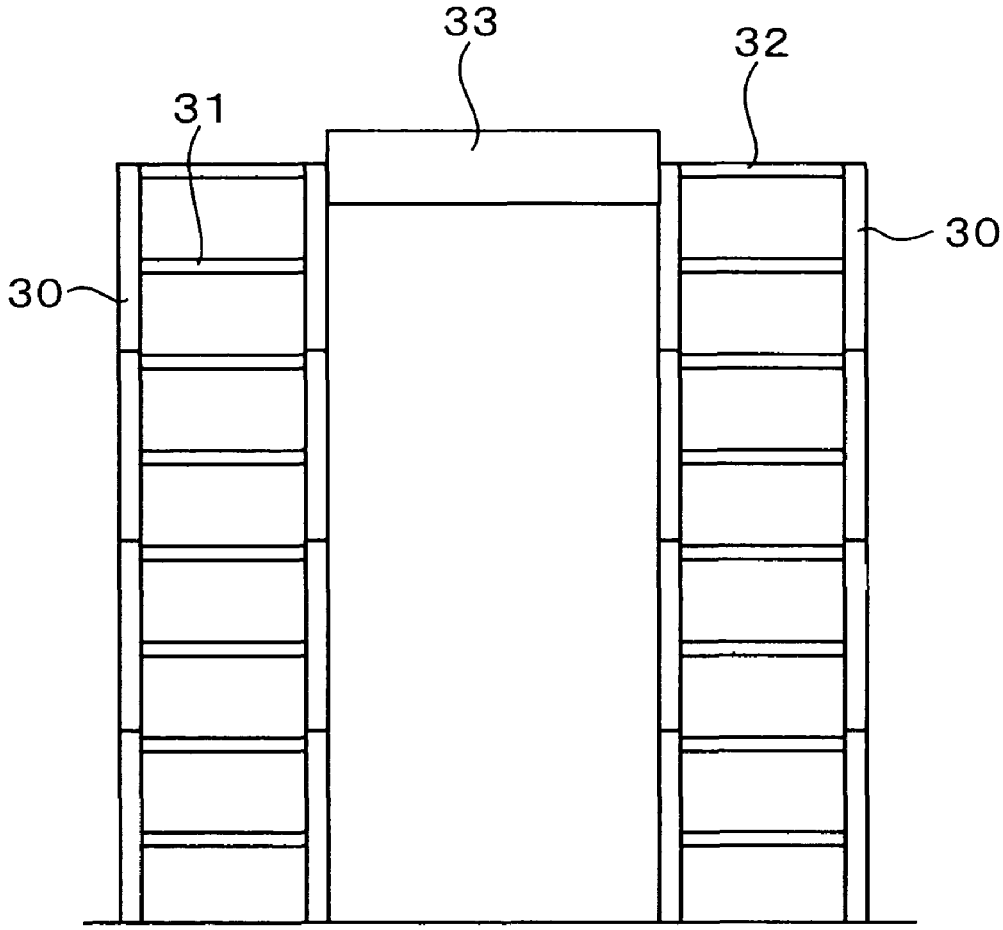
FIG. 27 PRIOR ART
FIG. 27 is a view taken along line A-A in FIG. 26.
Figure 28:
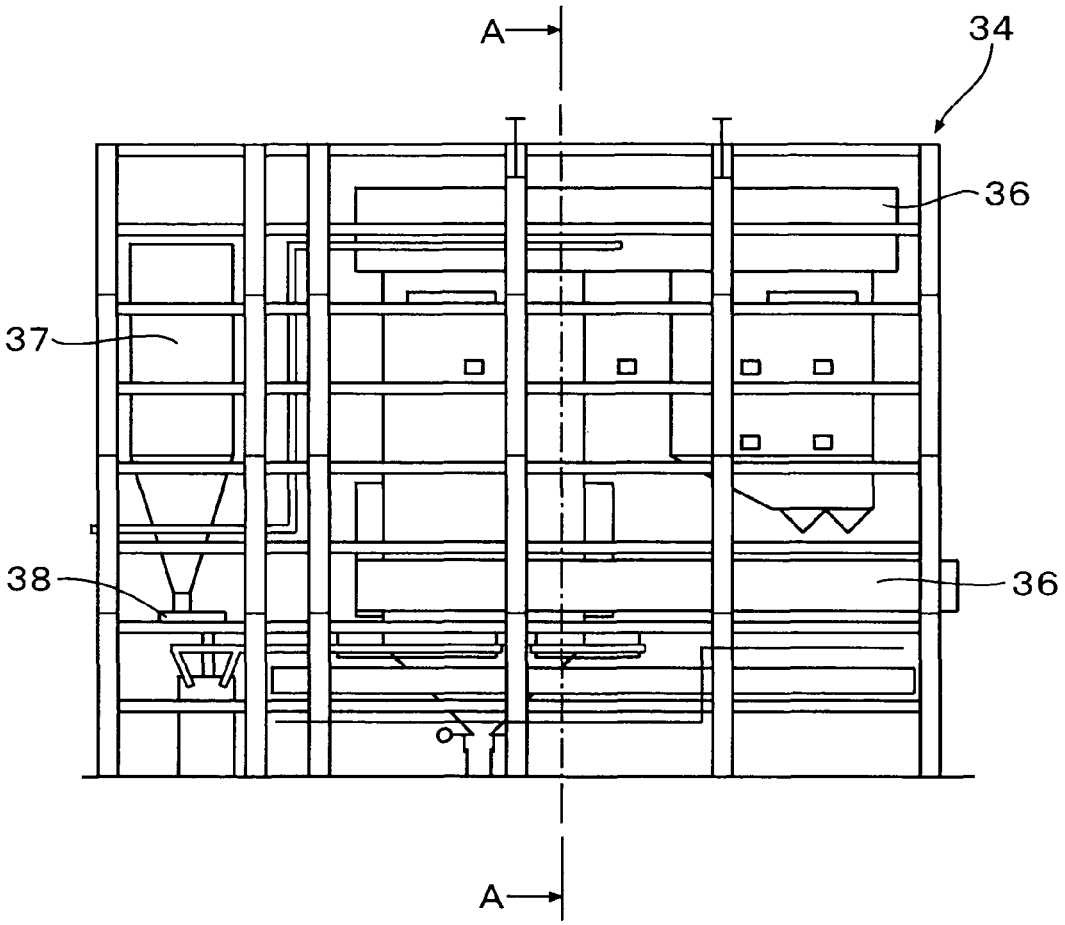
FIG. 28 PRIOR ART
FIG. 28 is a schematic configuration diagram for describing a conventional boiler facilities installation construction method.
Figure 29:
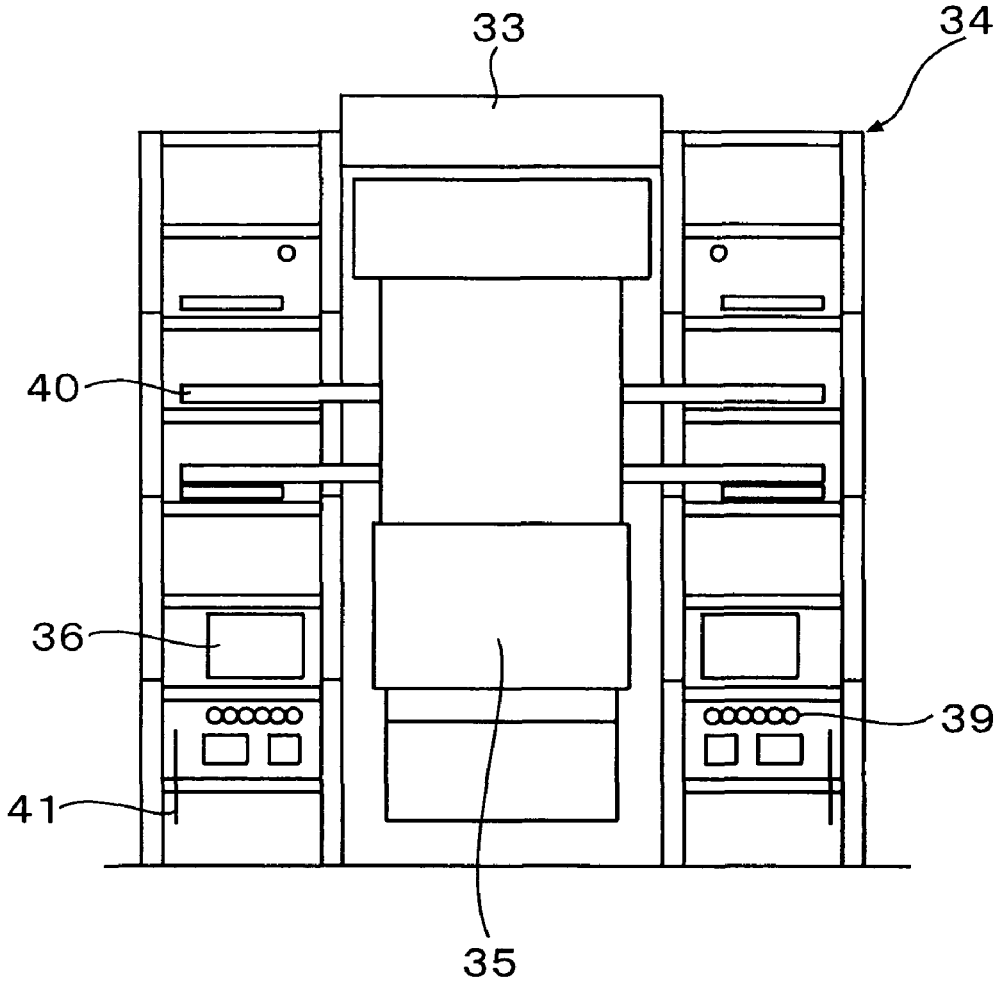
FIG. 29 PRIOR ART
FIG. 29 is a view taken along line A-A in FIG. 28.

FIG. 18 illustrates a state of installing the air pre-heater discharge gas duct 17, air pre-heater 5, economizer discharge gas duct 16, and so forth, following installing the boiler main unit 35 (not shown). Thus, installation of the boiler facilities is completed.

While the mill 8 and bunker 9 and the like are exemplarily described as being installed to the front of the boiler building 34 in the above embodiment, these may be disposed to the sides of the boiler building 34.

What is claimed is:

1. An installation construction method for boiler facilities in which said boiler facilities comprise:

a boiler building configured of a steel structure;

a boiler main unit to be installed within said boiler building;

equipment to be installed to said boiler main unit; and accessory members which are accessory thereto;

wherein the installation construction method comprises the acts of:

(a) assembling a predetermined number of first-level steel columns and disposing a first floor unit between said first-level steel columns;

(b) carrying in above said first floor unit and installing equipment and accessory members to be installed above said first floor unit;

(c) assembling second-level steel columns upon the first-level steel columns and disposing a second floor unit between said second-level steel columns;

(d) carrying in above said second floor unit and installing equipment and accessory members to be installed on said second floor unit;

(e) repeating steps (a)-(d) for any additional levels such that assembly of said boiler building and carrying in and installation of said equipment and accessory members are performed in parallel; and (f) disposing top girders between top level steel columns, from which top girders said boiler main unit is suspended.

2. The installation construction method for boiler facilities according to claim 1, wherein floor units, having at least floor beams and a floor, assembled beforehand within a hoisting limit load of a crane, are carried in and installed in parallel with construction of said boiler building.

3. The installation construction method for boiler facilities according to claim 2, wherein tie-ins for tying in to tie-in portions of the boiler building are provided to said floor units.

4. The installation construction method for boiler facilities according to claim 2, wherein a floor unit integral article, configured by said floor unit, and at least one of said various types of equipment and accessory members accessory thereto, being assembled beforehand within a hoisting limit load of a crane, is carried in and installed in parallel with construction of said boiler building.

5. The installation construction method for boiler facilities according to claim 1, wherein a duct block, having at least a duct casing panel, internal support, and a damper, assembled beforehand within a hoisting limit load of a crane, is carried in and installed in parallel with construction of said boiler building.

6. The installation construction method for boiler facilities according to claim 5, wherein thermal insulation and cladding sheets are installed to said duct block beforehand.

7. The installation construction method for boiler facilities according to claim 1, wherein a fuel pipe block, having at least a fuel pipe and a supporting device thereof, assembled beforehand within a hoisting limit load of a crane, is carried in and installed in parallel with construction of said boiler building.

8. The installation construction method for boiler facilities according to claim 1, wherein piping, fabricated so as to be within a length to allow for transportation from factory to the site, is carried in and installed in parallel with construction of said boiler building.

9. The installation construction method for boiler facilities according to claim 1, wherein a piping skid, integrally linking at least piping and a valve, is carried in and installed in parallel with construction of said boiler building.

10. The installation construction method for boiler facilities according to claim 1, wherein a bunker block, in which component parts of a bunker are assembled in a ring form beforehand within a hoisting limit load of a crane, is carried in and installed in parallel with construction of said boiler building.

11. The installation construction method for boiler facilities according to claim 1, wherein said boiler building is in a shape of a box when viewed from above until said boiler main unit is strung within, into which said boiler building being built in the shape of the box when viewed from above cranes enter and carry equipment and accessory members; and wherein said boiler main unit is inserted from one side opening of said boiler building in the shape of the box when viewed from above and suspended therefrom after the assembly of said boiler building is completed.

* * * * *